US007475485B1

(12) United States Patent
Hamm et al.

(10) Patent No.: US 7,475,485 B1
(45) Date of Patent: Jan. 13, 2009

(54) ARCHERY BOW YARDAGE TAPE APPARATUS

(76) Inventors: Harold M. Hamm, 7222 TownLine Rd., Wis. Rapids, WI (US) 54494; Brian H Hamm, 5490 Wilderness La., Wis. Rapids, WI (US) 54494; Christopher A. Hamm, 4860 Spruce Ave., Wis. Rapids, WI (US) 54494

( * ) Notice: Subject to any disclaimer, the term of this patent is extended or adjusted under 35 U.S.C. 154(b) by 0 days.

(21) Appl. No.: 11/984,338

(22) Filed: Nov. 16, 2007

(51) Int. Cl.
*F41G 1/467* (2006.01)

(52) U.S. Cl. ..... 33/265; 33/758; 124/87

(58) Field of Classification Search ..... 33/265, 33/758–760, 764, 768, 770; 124/87–89
See application file for complete search history.

(56) References Cited

U.S. PATENT DOCUMENTS 3,455,027 A * 7/1969 Perkins ..... 33/265
4,153,999 A * 5/1979 O'Steen ..... 33/265
5,465,491 A * 11/1995 Thell ..... 33/265
6,079,111 A * 6/2000 Williams et al. ..... 33/265
6,196,455 B1 * 3/2001 Robinson ..... 235/70 A
6,651,355 B2 * 11/2003 Byrd ..... 33/760
6,796,039 B2 * 9/2004 Walbrink ..... 33/265
6,839,994 B2 * 1/2005 Proctor ..... 124/90
7,360,313 B1 * 4/2008 Hamm et al. ..... 33/265

* cited by examiner

*Primary Examiner*—Yaritza Guadalupe-McCall
(74) *Attorney, Agent, or Firm*—John Richardson

(57) ABSTRACT

The archery bow yardage tape apparatus comprises one or more set-up tapes, selectively incremented to correspond to the distance between adjacent marks. A plurality of distance yardage tapes are selectively incremented and color coded for ease of identification. A conversion chart is used to identify the distance yardage tape by marking the set-up tape at two selective distances, such as twenty yards and sixty yards, and subtracting the smaller marking from the larger marking, to determine the setting on the conversion chart. The setting on the conversion chart corresponds to the number on the distance yardage tape, which is positioned over the set-up tape on the bow yardage tape apparatus. The distance yardage tape then identifies the elevation required to reach a target at any specified distance from the target.

20 Claims, 7 Drawing Sheets

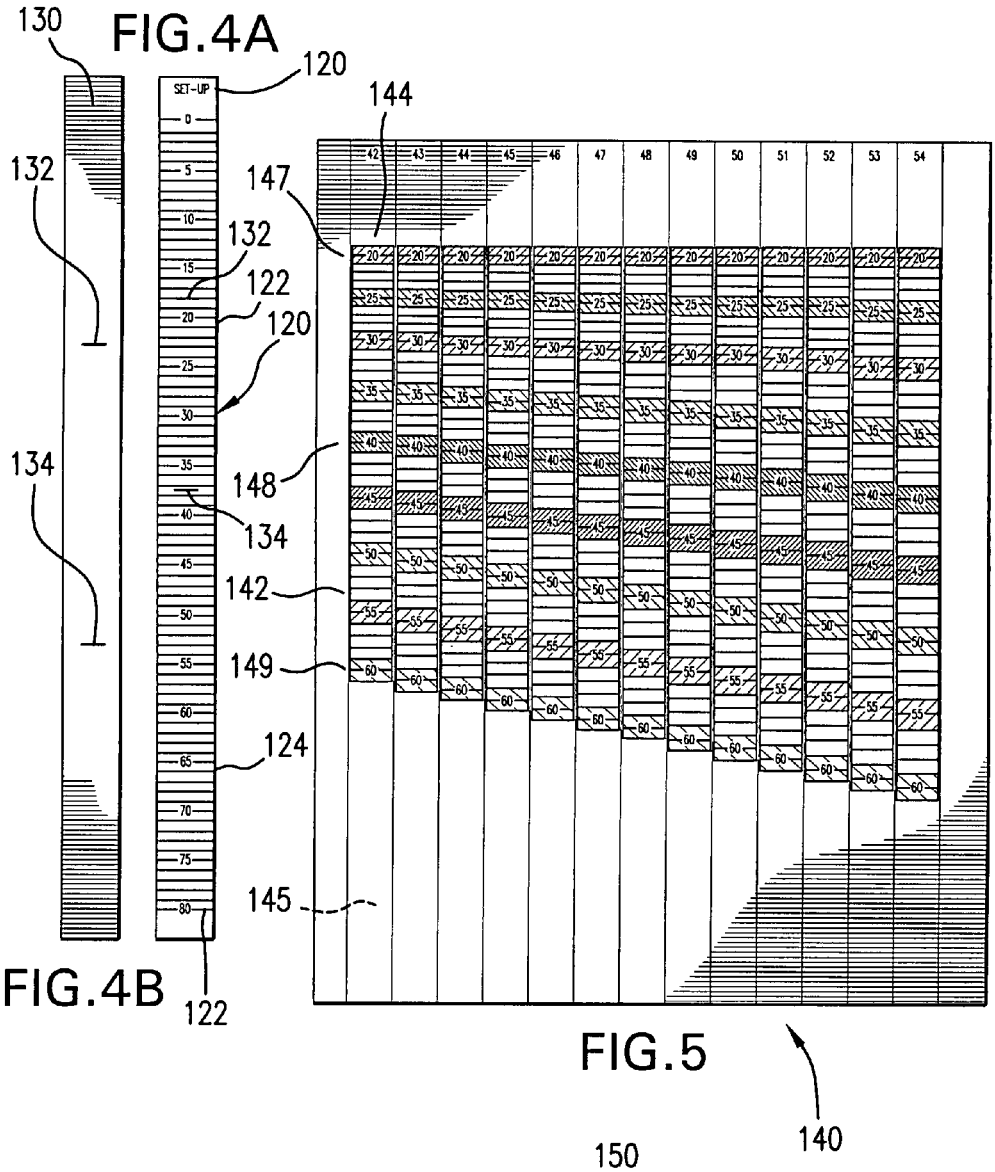
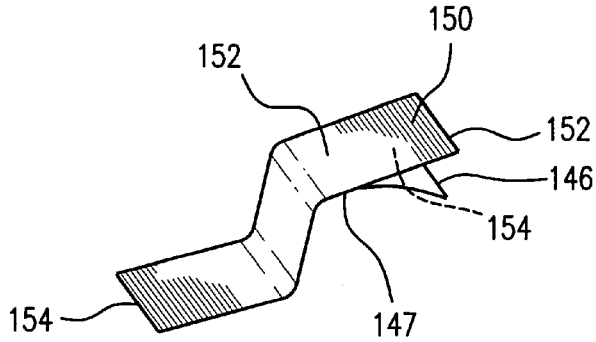
FIG.6

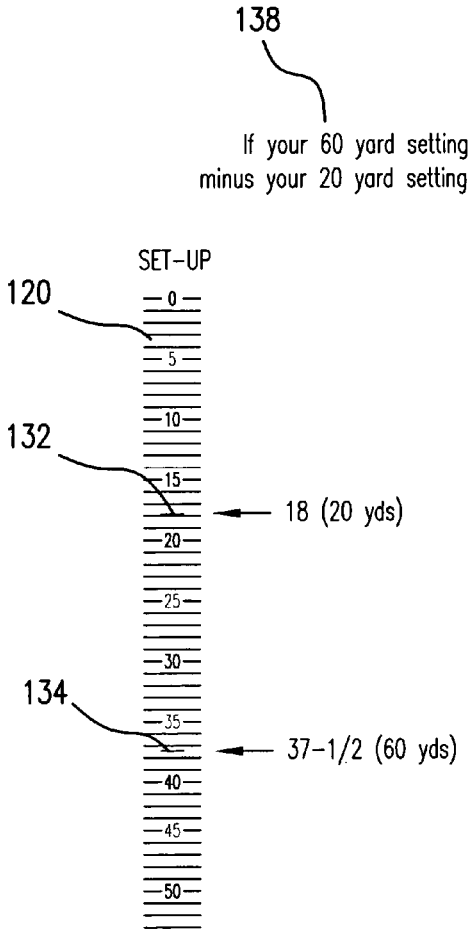

FIG.8A

136 CONVERSION CHART
20 yard and 60 yard sightings

| | | | |
|---|---|---|---|
| 13 | Use Tape 29 | 23 1/2 | Use Tape 52 |
| 13 1/2 | Use Tape 30 | 24 | Use Tape 53 |
| 14 | Use Tape 31 | 24 1/2 | Use Tape 54 |
| 14 1/2 | Use Tape 32 | 25 | Use Tape 55 |
| 15 | Use Tape 33 | 25 1/2 | Use Tape 56 |
| 15 1/2 | Use Tape 34 | 26 | Use Tape 57 |
| 16 | Use Tape 36 | 26 1/2 | Use Tape 58 |
| 16 1/2 | Use Tape 37 | 27 | Use Tape 59 |
| 17 | Use Tape 38 | 27 1/2 | Use Tape 60 |
| 17 1/2 | Use Tape 39 | 28 | Use Tape 61 |
| 18 | Use Tape 40 | 28 1/2 | Use Tape 62 |
| 18 1/2 | Use Tape 41 | 29 | Use Tape 64 |
| 19 | Use Tape 42 | 29 1/2 | Use Tape 65 |
| 19 1/2 | Use Tape 43 | 30 | Use Tape 66 |
| 20 | Use Tape 44 | 30 1/2 | Use Tape 67 |
| 20 1/2 | Use Tape 45 | 31 | Use Tape 68 |
| 21 | Use Tape 47 | 31 1/2 | Use Tape 69 |
| 21 1/2 | Use Tape 48 | 32 | Use Tape 70 |
| 22 | Use Tape 49 | 32 1/2 | Use Tape 71 |
| 22 1/2 | Use Tape 50 | 33 | Use Tape 72 |
| 23 | Use Tape 51 | | |

FIG.8B

ARCHERY BOW YARDAGE TAPE APPARATUS

CROSS-REFERENCE TO RELATED TOPICS

Not applicable.

STATEMENT REGARDING FEDERALLY SPONSORED RESEARCH OR DEVELOPMENT

Not Applicable.

REFERENCE TO SEQUENCE LISTING A TABLE, OR A COMPUTER PROGRAM LISTING COMPACT DISK APPENDEX

Not Applicable.

BACKGROUND OF THE INVENTION

Archery shooting requires accurate placement of an arrow to a target. The bow size and strength varies within similar models and brands. Different models and brands produce different results. The arrow size, balance and weight affects performance. The strength and steadyness of the user also affects placement of an arrow in relation to a target. Other factors that influence the vertical placement of the sight pin in relation to the distance to the target include: Arrow velocity and weight; the distance from the shooter's eye to the sight pin; and the vertical distance from the shooter's eye to the nock of the arrow. The distance from the user to a target has a great impact on accuracy. The greater the distance, the higher the tragectory required to reach the target.

Thus, it is difficult to accurately place an arrow in a target, without accurately compensating for these variables. One method of improving accuracy is to practice with the same bow and arrow at a selected distance from the target. With practice, the user will greatly improve the placement of an arrow in relation to a target at a selected distance, such as twenty yards. Once achieving consistant accuracy at this distance, the user must then concentrate on achieving consistant results at a greater distance, such as thirty yards, forty yards, fifty yards, sixty yards, or more. Over time, the archer will gain skill at varying distances, which is critical when bow hunting.

Many archery bow sight devices use levers, pins, dials, adjustment screws, cross hairs, etc. to fix the target in relation to distance. Unfortunately, there are few devices which link the distance to the target with the user's equipment, without manually aligning the bow sight device to each specific distance to the target.

A few devices provide an arcuate or circular bow sight apparatus to mark the distance to a target, in relation to the user's equipment. One such arcuate device is U.S. Pat. No. 5,975,069 issuing on Nov. 2, 1999 to Harold M. Hamm et al. One such circular device is U.S. patent application Ser. No. 11/593,614 filed on Nov. 7, 2006 by Harold M. Hamm et al.

Applicant has discovered a novel means and apparatus which enables a user to sight in their bow at two fixed distances, such as twenty yards and sixty yards (or forty yards), to determine the elevation variation with the aid of an incremental set-up tape, and then select the appropriate distance yardage tape from a set of incremental pre-printed distance yardage tapes. Thereafter, the user may move the archery bow sight apparatus to any selected distance, from twenty yards to sixty yards or more, and accurately position the target in relation to the distance from the target. This apparatus may be adapted for new and existing archery bow sight apparatus, including arcuate and circular graphical images.

BRIEF SUMMARY OF THE INVENTION

Accordingly, it is an object of this invention to provide an improved apparatus for determining the distance to a target in relation to the elevation required to hit a target, for specific archery equipment.

It is another object of the present invention to provide an incremental set-up tape to determine the elevation required to reach a target at two distinct distances, such as twenty yards and sixty yards, and to use the markings on the set-up tape to select the appropriate distance yardage tape, for subsequent use at any one of a variety of distances.

It is still another object of the present invention to provide a plurality of distance yardage tapes of selected increments, to enable the user to select one of the distance yardage tapes based upon tests conducted at two distinct distances by marking the results on a set-up tape, and to select a distance yardage tape based upon the difference between the marks on the set-up tape, and to use a conversion chart to select the most accurate distance yardage tape, and to selectively position the selected distance yardage tape over the incremental set-up tape to enable the user to thereafter select the appropriate distance yardage tape for the user's archery equipment, to accurately determine the elevation required to reach a specific target at a given distance.

It is a further object of the present invention to mark the set-up tape at two selected distances, to select the proper distance yardage tape for specific archery equipment, such as a side mounted circumferential display, a front face circumferential display or an arcuate display.

It is yet another object of the present invention to provide a set-up tape with equally spaced numbers from at least 0 to 80, for use with a front face or side mounted circumferential display.

It is still another object of the present invention to provide a set-up tape with equally spaced numbers from at least 0 to 65, for use with an arcuate display.

It is a further object of the present invention to color-code at least one of the set-up tape(s) and the distance yardage tape(s) at selected distances from the target.

The bow yardage tape apparatus comprises one or more set-up tapes, selectively incremented to correspond to the distance between adjacent marks. A plurality of distance yardage tapes are selectively incremented and numbered for ease of identification. A conversion chart is preferably used to identify the appropriate distance yardage tape by marking the set-up tape at two selected distances, such as twenty yards and sixty yards, and subtracting the larger number from the smaller number, to determine the setting on the conversion chart. The setting on the conversion chart corresponds to the tape number located on the distance yardage tape. The selected distance yardage tape is then selectively positioned over the set-up tape on the bow yardage tape apparatus. The sight pin on the bow site is preferably positioned over the markings on the distance yardage tape to determine the elevation required to reach a target at a specified distance from the target for specific archery equipment.

These, and other objects of the present invention will become apparent to one of average skill in this art upon review of the following drawings, specification and claims.

BRIEF DESCRIPTION OF SEVERAL VIEWS OF THE DRAWINGS

FIG. 4A is a front view of a set-up tape prior to installation on an archery bow sight apparatus.

FIG. 4B is a front view of an incremental set-up tape, showing markings made at two select distances.

FIG. 5 is a detailed view of a plurality of distance yardage tapes which are incrementally adjusted in length and selectively coded to correspond with the difference between the larger number minus the smaller number located on the set-up tape. (Note that each succeeding distance yardage tape is one increment longer than the preceeding distance yardage tape).

FIG. 6 is a top view of a clear mylar tape used to cover the selected distance yardage tape, to protect and strengthen the selected distance yardage tape upon installation on the archery bow sight apparatus. (One or two clear maylar tape portions may be used to cover the distance yardage tape).

FIG. 8A is a sample set-up tape, showing marks indicating the position of the alignment pin at 20 yards and 60 yards.

FIG. 8B is a conversion chart identifying the distance yardage tape in relation to the difference between the numbers on the set-up tape at sixty yards minus 20 yards. The difference is identified by numbers (13-33) on the conversion chart, and the appropriate distance yardage tape is identified by numbers (42-54) at the top of each distance yardage tape. (Additional distance yardage tapes may be provided). (see FIG. 5).

DETAILED DESCRIPTION OF THE INVENTION

Figure 1A:
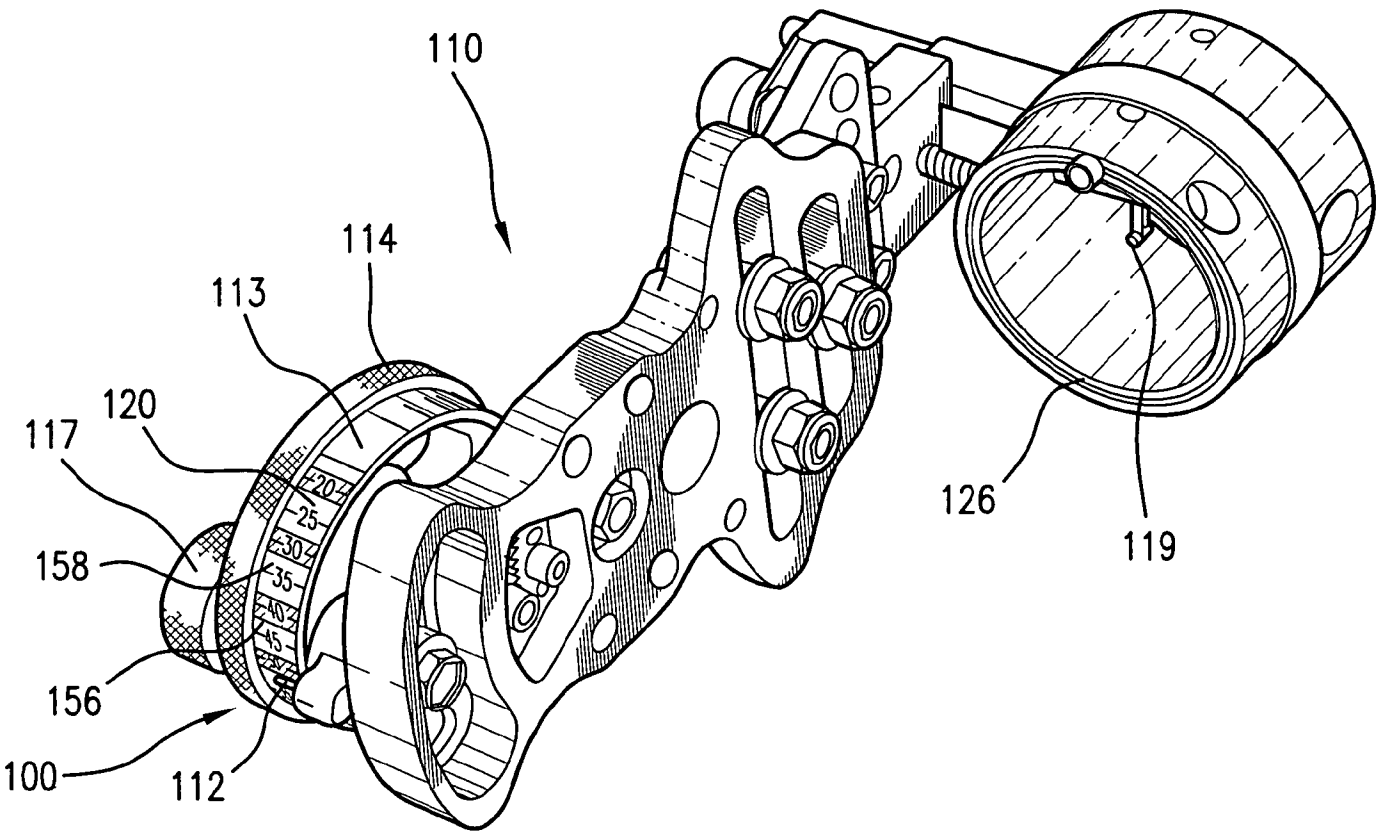
FIG. 1A is a perspective view of the selected distance yardage tape mounted to an archery bow sight apparatus having a circumferential display.
Figure 1C:
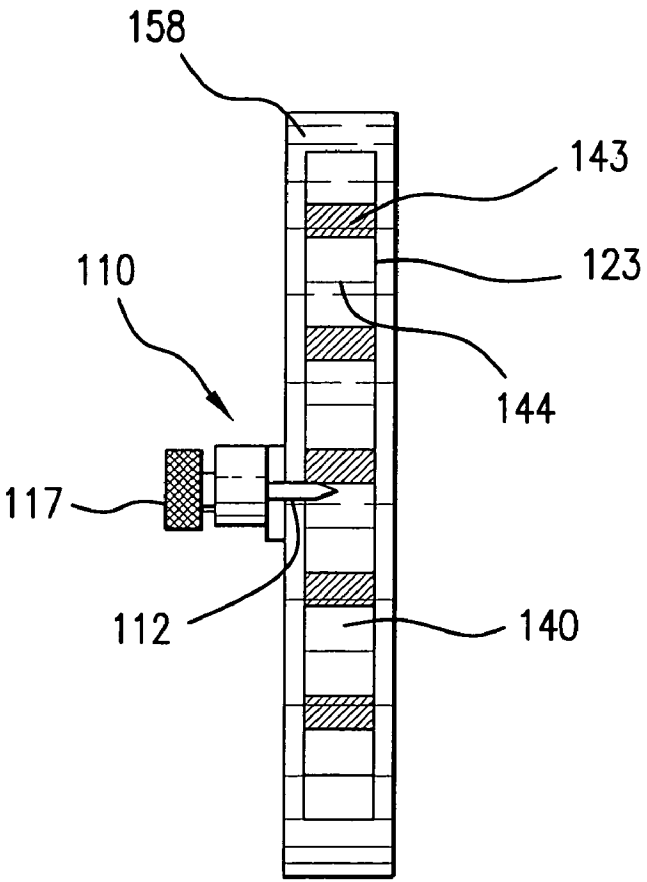
FIG. 1C is an end view of the selected distance yardage tape mounted to an archery bow sight apparatus having an arcuate display.
Figure 1B:
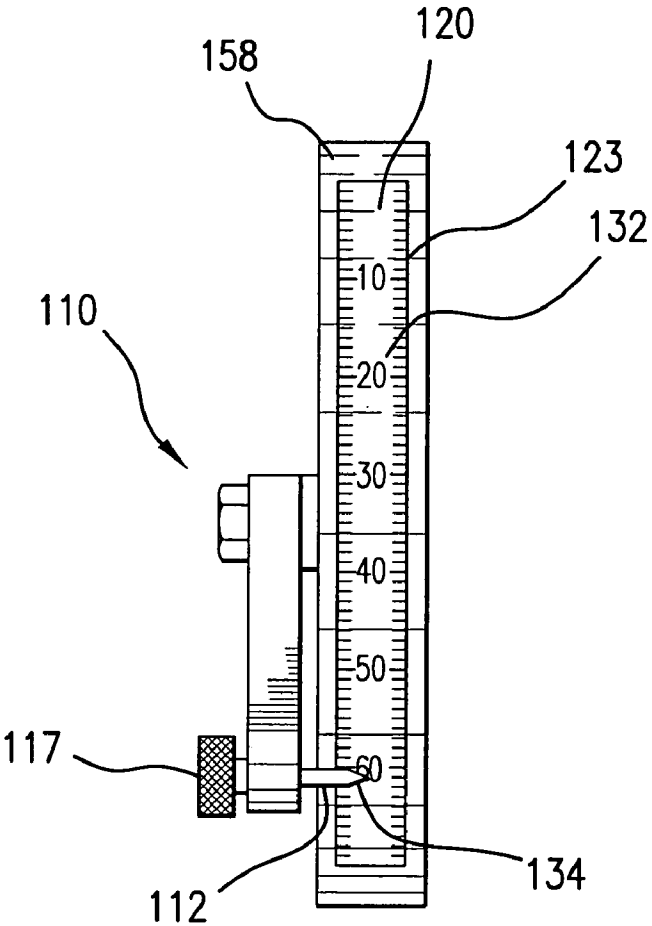
FIG. 1B is an end view of the set-up tape mounted to an archery bow sight apparatus having an arcuate display.
Figure 2A:
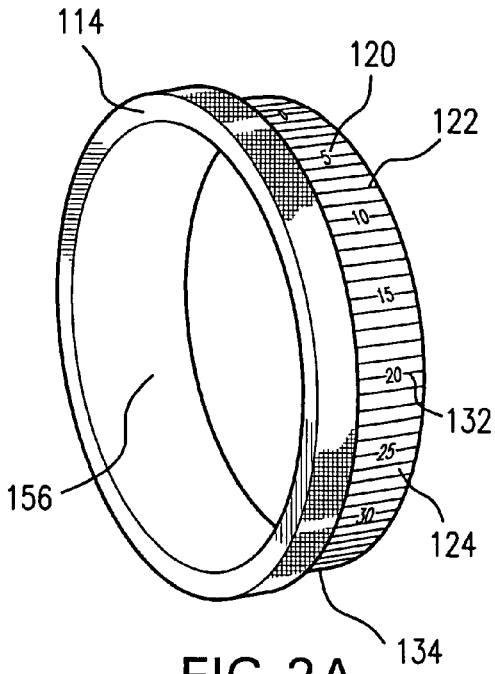
FIG. 2A is a perspective view of a set-up tape mounted to an archery bow sight apparatus having a side mounted circumferential display.
Figure 2B:
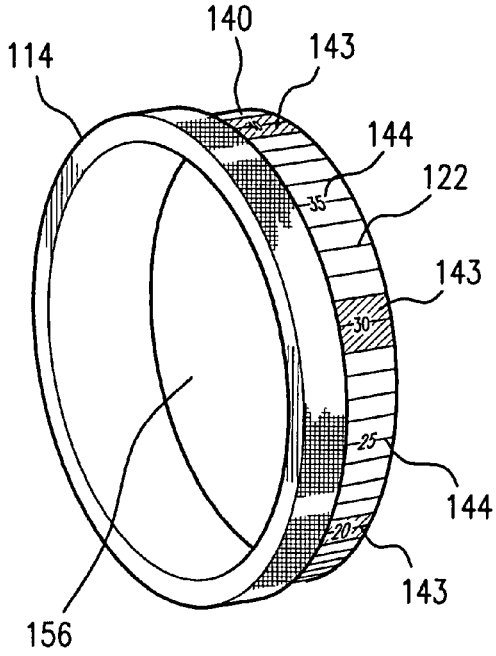
FIG. 2B is a perspective view of the selected distance yardage tape mounted to an archery bow sight apparatus having a side mounted circumferential display.
Figure 3:
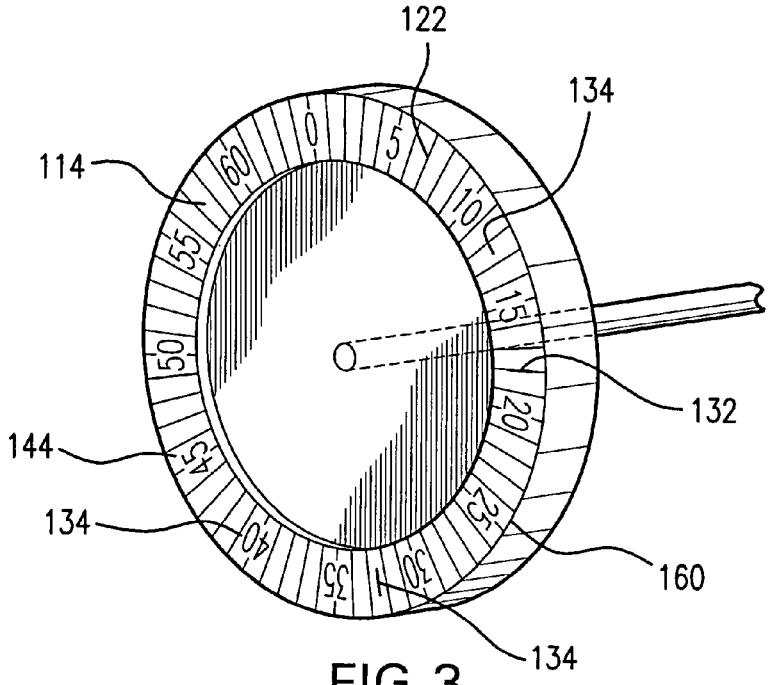
FIG. 3 is a perspective view of the selected distance yardage tape mounted to an archery bow sight apparatus having a front mounted circular display.
Figure 7A:
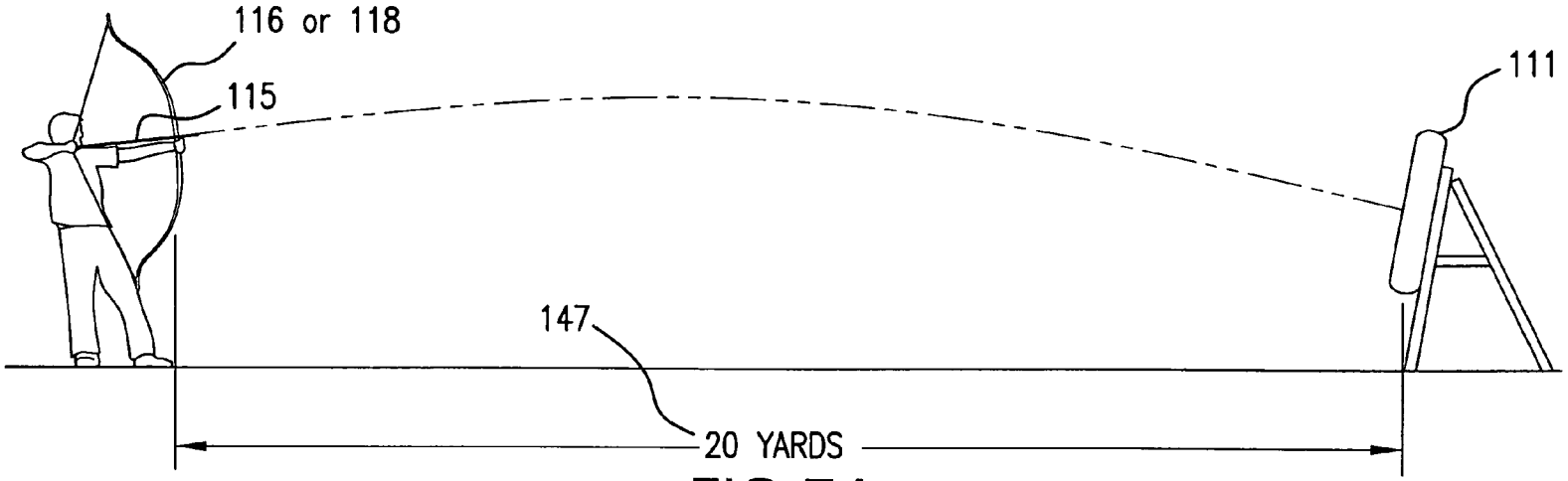
FIG. 7A is an elevation view of a user launching an arrow at a target 20 yards away. (Note the trajectory of the arrow flight at 20 yards).
Figure 7B:
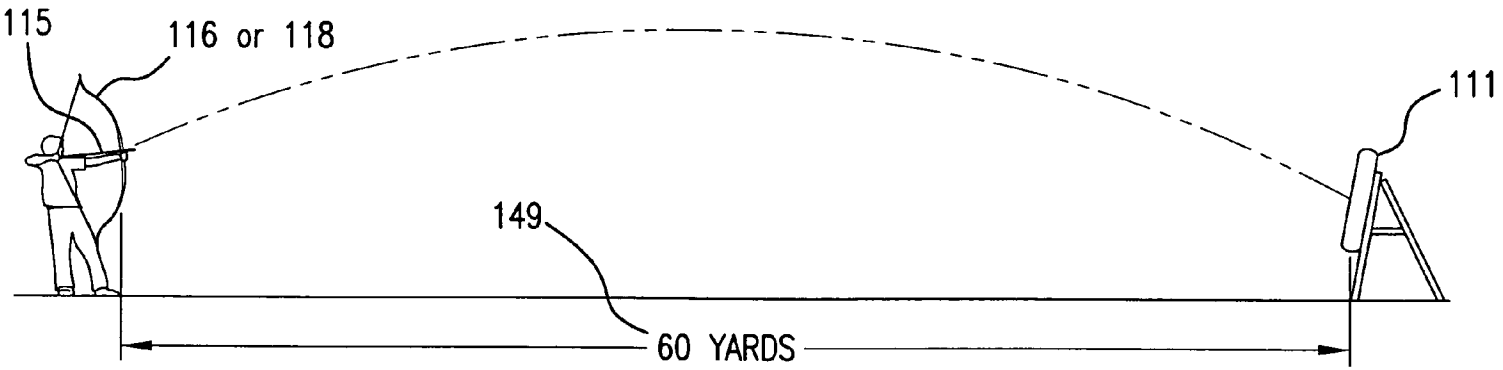
FIG. 7B is an elevation view of a user launching an arrow at a target 60 yards away. (Note the higher trajectory of the arrow flight at sixty yards, compared to the trajectory of the arrow flight at 20 yards, shown in FIG. 7A).
Figure 9:
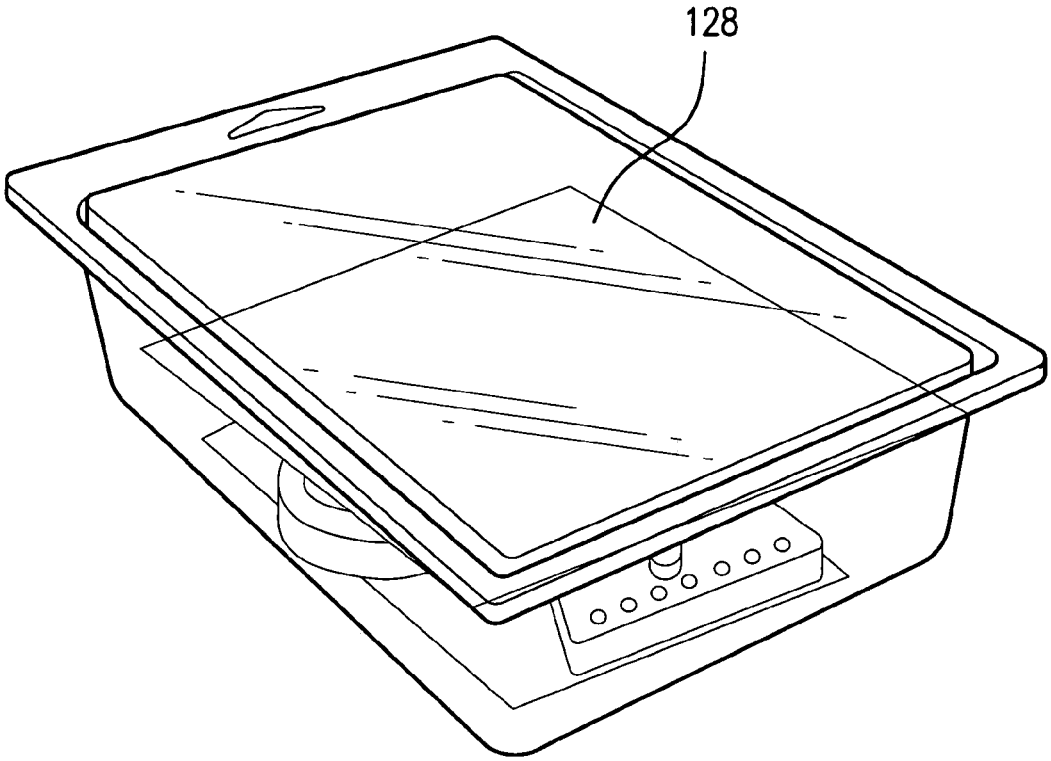
FIG. 9 is a perspective view of a container kit used to store and ship the archery bow yardage tape apparatus.

As shown in FIG. 1 through FIG. 9, the archery bow yardage tape apparatus 100 disclosed herein is secured to the archery bow sight apparatus 110, comprises one or more set-up tapes 120, preferably incremented 122 from one to eighty units for a side mounted or front face circumferential display 156, 160. The set-up tapes 120 for an arcuate display 158 is preferably incremented 123 from one to sixty-five units. Each unit preferably represents 1/32 inch. Each set-up tape 120 is selectively incremented 124 to correspond to the distance between adjacent marks. The indicia on at least one of the set-up tape(s) and the distance yardage tape(s) are preferably color coded for ease of identification.

In addition, there are one or more blank writeable tapes 130, and a plurality of distance yardage tapes 140. The number of distance yardage tapes 140 are preferably from twenty up to sixty distance yardage tapes 140, with forty-four distance yardage tapes 140 most preferred. The distance yardage tapes 140 are best shown in FIG. 5. Please note that each succeeding distance yardage tape is one increment longer than the preceeding distance yardage tape.

The distance yardage tapes 140 are selectively incremented 142 to correspond to the indicia 144 provided on each distance yardage tape 140. The indicia 144 is preferably color coded 143, for ease of identification.

To select a distance yardage tape 140 using the most accurate system, the user must first sight in at twenty yards 147 and then at sixty yards 149 from the target 111. Alternately, you may sight in at twenty yards 147 and forty yards 148, for example.

Preferably, in order to select the proper distance yardage tape 140 you must have a first range with a measured twenty yards 147 to a target 150 and a second range with a measured sixty yards 149 (or 40 yards 148) to the target 111.

The set-up tape 120 preferably has a range of selectively incremented numbers 142 from 0-80 installed on the set-up tape 120. The incremented numbers 142 identified as 0-80 units 122 are provided as a means of measuring and selecting the appropriate distance yardage tape 140.

To sight in your bow yardage tape apparatus 100, you must first align the target sight 119 on your bow 111 at a measured twenty yards 147 and mark 132 the set-up tape 120 accordingly. Then move the movable alignment pin 112 up and down by rotating the dial 114 using the adjustment knob 117. For a Right Hand Bow 116, rotate the dial 114 clockwise to raise your arrow trajectory 115, or counter clockwise to lower your arrow 115 trajectory.

For a left hand bow 118, rotate the dial 114 counterclockwise to raise your arrow 115 trajectory, or clockwise to lower your arrow 115 trajectory. Once you have an extremely accurate sight-in at twenty yards, mark the set-up tape 120 with a twenty yard mark 132 and make note of the incremented number between 1-80 on the set-up tape 120 nearest to the alignment pin 112. For example, if your alignment pin 112 is closest to number 18, mark number 18 on your set-up tape 120. If your alignment pin 112 is closest to number 19, mark number 19 on your set-up tape 120. If you alignment pin 112 is halfway between number 18 and number 19, mark the space 18½ on your set-up tape 120. This mark will be your twenty yard identification mark 132.

Next move the target 111 out to a measured sixty yards. For a Right Hand bow 116, adjust the sighting aperture 126 downward by rotating the dial 114 clockwise until you have achieved an accurate sighting at sixty yards 134. For a left hand bow 118, adjust the sighting aperture 126 counter clockwise. The accuracy of the entire shooting system depends on an extremely accurate sighting to selected measured distances, such as twenty yards and sixty yards, or twenty yards and forty yards, for example.

Once you have an extremely accurate sight in at sixty yards, mark and make note of the number on the set-up tape 120 nearest to the alignment pin 112. This will be your sixty yard mark 134. For example: if the alignment pin 112 is closest to number 37 on your set-up tape 120, mark number 37 on your set-up tape 120. If your alignment pin 112 is closest to number 37½ on the set-up tape, mark the space 37½ on your set-up tape 120. This will be your sixty yard identification mark 134.

Now that you have sighted in at twenty yards and sixty yards, use the following procedure to select the correct distance yardage tape 140. Subtract your 20 yard identification mark (example 18) from your sixty yard identification mark (example 37Y2). Answer: 18–37½=19½. This number can be determined with a calculator, computer, or by simple subtraction.

Referring now to the conversion chart 136 shown in FIG. 8, the distance yardage tapes 140 are preferably numbered from 29 to 72. If the difference between the twenty yard identification mark 132 and the sixty yard identification mark is 19½, then the conversion chart 136 for 19½ is distance yardage tape 140 identified as tape 43.

Carefully remove the correct distance yardage tape 140 (example tape 43) from the backing paper 145, and position the selected distance yardage tape 140 over the top of the set up tape 120, by placing the sixty yard indicia 149 on the distance yardage marker 140 directly over the sixty yard mark 134 made on the set-up tape 12. This can be easily done by placing and securing the alignment pin 112 directly over the mark indicating the sixty yard setting 134 on the set-up tape 120, and then placing the distance yardage tape 140 indicating the sixty yard 148 setting directly under the sight pin 112. Then carefully roll the selected distance yardage tape 140 in both directions, to secure the sticky side 146 of the distance yardage tape 140 to the set-up tape 120, leaving the incremented numbers 142 visible to the user. It is not necessary to remove the set-up tape 120.

This will position the twenty yard mark 132 on the set-up tape 120 directly under the twenty yard 147 indicia 144 on the distance yardage tape 140. All of the yardages between the twenty yard 147 indicia 144 and the sixty yard 148 indicia 144 are now in place.

Next remove one of the clear Mylar tapes 150 from the container kit 128 and cover the first and second ends 152, 154 of the distance yardage tape 140. Alternately, use the clear mylar tape 150 to cover the distance yardage tape 140 to the circumferential display 156, or to the arcuate display 158, or to the circular display 160. This will prevent the ends 52, 54 of the distance yardage tape 140 from coming loose during use.

You are now ready to use the bow yardage tape apparatus 100 at varying distances from the target 111. Move 10 yards beyond the 20 yard mark, set the sight pin 112 on the thirty yard mark. Shoot at the target 111, and your arrow should hit the target 111.

Experiment at various distances from the target 111, to gain confidence in your bow yardage tape sight apparatus 100. The bow yardage tape apparatus 100 will provide accurate elevation at selected distances from the target 111. With continued practice at varying distances from the target 111, you will develop confidence in your ability to accurately hit the target 111 time after time.

The archery bow yardage tape apparatus 100 disclosed herein, is for attachment to a new or existing archery bow sight 110 having a movable alignment pin 112 positioned in relation to a display surface 113 on the archery bow sight 110. One or more set-up tapes 120 are provided. Each set-up tape 120 includes a plurality of incremented indicia 142. The set-up tape 120 is adapted for securement to the display surface 113 on the archery bow sight 110. The display surface 113 is sized to substantially cover the entire range of movement of the movable alignment pin 112.

To use, mark the set-up tape 120 at a first known distance to a target 111, such as 20 yards 132, then mark the set-up tape 120 at a second known distance to the target, such as 60 yards 134. Look up the difference on the conversion chart 136 provided, to select the closest distance yardage tape 140 from a plurality of distance yardage tapes provided. Note that each distance yardage tape is selectively incremented with indicia representative of the setting of the alignment pin on the archery bow sight apparatus at the two known distances; and position and secure the selected distance yardage tape over the set-up tape to enable a user to accurately determine the elevation required to reach a specific target at other distances to the target.

While the present invention has been illustrated in conjunction with a detailed description of the preferred invention, it will be obvious to those skilled in this art that various changes in form and detail can be made without departing from the scope of this invention, or from the following claims. Such changes and adaptations are intended to fall within the scope of the following claims.

ARCHERY BOW YARDAGE TAPE APPARATUS PARTS LIST

100—archery bow yardage tape apparatus
110—Archery bow sight apparatus
111—target
112—movable alignment pin
113—display surface
114—dial
115—arrow
116—right hand bow
117—adjustment knob
118—left hand bow
119—target sight
120—set-up tape
122—1-80 units
123—1-65 units
124—selectively incremented
126—sighting aperture
128—container kit
130—blank writeable tape
132—twenty yard mark on set-up tape
134—sixty yard mark on set-up tape
136—conversion chart
138—instructions
140—distance yardage tapes
142—selectively incremented indicia
143—color coded
144—distance indicia
145—backing paper
146—sticky side
147—twenty yard
148—forty yard
149—sixty yard
150—clear mylar tape
152—first end of tape
154—second end of tape
156—side mounted circumferential display
158—arcuate display
160—front face circular display

What is claimed is:

1. An archery bow yardage tape apparatus, for attachment to a new or existing archery bow sight having a movable alignment pin positioned in relation to a display surface on the archery bow sight apparatus, comprising:

a) one or more set-up tapes, each set up tape with a plurality of selectively incremented indicia, the set-up tape adapted for securement to the display surface on the archery bow sight apparatus, the display surface sized to substantially cover the entire range of movement of the movable alignment pin;

b) mark the set-up tape at a first known distance to a target, then mark the set-up tape at a second known distance to the target, and use the difference to determine the tragectory required at other selected distances from the target;

c) select a distance yardage tape from a plurality of distance yardage tapes, each distance yardage tape selectively incremented with indicia representative of the setting of the alignment pin on the archery bow sight apparatus at the two known distances; and d) position and secure the selected distance yardage tape over the set-up tape to enable a user to accurately determine the elevation required to reach a specific target at other distances to the target.

2. The archery bow yardage tape apparatus of claim 1, wherein the distance yardage tapes are selectively designed for use with one of: a side mounted circumferential display, a front face circumferential display and an arcuate display.

3. The archery bow yardage tape apparatus of claim 1, wherein the set-up tapes are preferably numbered from at least 0 to 80, for use with one of a front face circumferential display and a side mounted circumferential display.

4. The archery bow yardage tape apparatus of claim 1, wherein the set-up tapes are preferably numbered from at least 0 to 65, for use with an arcuate display.

5. The archery bow yardage tape apparatus of claim 4, wherein the indicia on at least one of the set-up tape and the distance yardage tapes is preferably selectively color coded.

6. The archery bow yardage tape apparatus of claim 1, wherein a first known tested distance to the target is twenty yards, and a second known tested distance to the target is sixty yards.

7. The archery bow yardage tape apparatus of claim 6, wherein a first known tested distance to the target is twenty yards, and a second known tested distance to the target is alternately selected to be forty yards.

8. The archery bow yardage tape apparatus of claim 1, wherein clear tape is used to secure the distance yardage tape over the set-up tape.

9. The archery bow yardage tape apparatus of claim 8, wherein the clear tape has a top side and a bottom side, and the bottom side has adhesive thereon, with a removable protective cover on the bottom side to protect the adhesive prior to securement of the clear tape to the selected distance yardage tape.

10. The archery bow yardage tape apparatus of claim 1, wherein the set-up tapes, the conversion chart, the plurality of distance yardage tapes, and the blank set up tapes are stored together in a suitable container kit.

11. The archery bow yardage tape apparatus of claim 1, wherein a conversion chart is used to select a distance yardage tape based on the difference between two marks made on the set-up tape at selected distances to the target, and the difference used to identify a selected distance yardage tape from a plurality of distance yardage tapes.

12. An archery bow yardage tape apparatus, for attachment to a new or existing archery bow sight, comprising:

a) one or more set-up tapes, each set up tape selectively incremented with indicia thereon, the set-up tape adapted for securement to one of, an arcuate side mounted arcuate display;

b) a plurality of distance yardage tapes preferably numbered from 29 to 72, each distance yardage tape selectively incremented with indicia representative of the setting on the archery bow sight apparatus at a given distance to the target;

c) a conversion chart to identify a selected distance yardage tape by subtracting the smaller number marked on the set-up tape from the larger number on the set-up tape to obtain a conversion number, and the conversion number is used to select the distance yardage tape from the plurality of distance yardage tapes provided; and d) the selected distance yardage tape is positioned and secured over the set-up tape to locate the target tragectory from any one of multiple distances.

13. The archery bow yardage tape apparatus of claim 12, wherein a selected distance yardage tape is positioned and secured over the set-up and secured thereto with clear tape.

14. The archery bow yardage tape apparatus of claim 12, wherein the indicia on the conversion chart identifies the distance between first and second distances to the target, and the shorter distance is subtracted from the greater distance to obtain a conversion number, and the conversion number is used to select the distance yardage tape from the plurality of distance yardage tapes provided.

15. The archery bow yardage tape apparatus of claim 12, wherein the indicia on the distance yardage tapes is selectively color coded.

16. The archery bow yardage tape apparatus of claim 12, wherein the two scanned distances from the bow yardage tape apparatus to the target are selected to be twenty yards and sixty yards.

17. The archery bow yardage tape apparatus of claim 12, wherein the two scanned distances from the bow yardage tape apparatus to the target are alternately selected to be twenty yards and forty yards.

18. An archery bow yardage tape apparatus, for attachment to a new or existing archery bow sight apparatus, comprising:

a) One or more set-up tapes configured for attachment to one of: an arcuate side mounted display, a front face circular display, and a side mounted circumferential display;

b) said set-up tapes of sufficient size and shape to cover the entire range of movement of the movable alignment pin on said archery bow sight;

c) said set-up tapes having a scale comprising a series of equally spaced, consecutively numbered indicators;

d) a plurality of distance tapes, each distance tape having a plurality of equally spaced, distance indicators;

e) and each consecutive distance tape being one increment longer than the previous distance tape, when measured from the shortest distance mark to the longest distance mark; and f) each distance tape bearing an identifying number corresponding to the total number of increments between the closest distance mark and the longest distance mark.

19. The archery bow yardage tape apparatus of claim 18, wherein the set-up tapes are preferably numbered from at least 0 to 80, for use with one of a front face circumferential display and a side mounted circumferential display.

20. The archery bow yardage tape apparatus of claim 18, wherein the set-up tapes are preferably numbered from at least 0 to 65, for use with an arcuate display.

* * * * *